US010143319B1

(12) United States Patent
Nichols

(10) Patent No.: US 10,143,319 B1
(45) Date of Patent: Dec. 4, 2018

(54) METHOD AND APPARATUS FOR SECURING AND CONTROLLING ACCESS TO THE STORAGE RECEPTACLES

(71) Applicant: Jasyl Arlyn Nichols, Little Rock, AR (US)

(72) Inventor: Jasyl Arlyn Nichols, Little Rock, AR (US)

( * ) Notice: Subject to any disclaimer, the term of this patent is extended or adjusted under 35 U.S.C. 154(b) by 49 days.

(21) Appl. No.: 15/388,437

(22) Filed: Dec. 22, 2016

Related U.S. Application Data

(60) Provisional application No. 62/270,911, filed on Dec. 22, 2015.

(51) Int. Cl.
*A47G 29/124* (2006.01)
*A47G 29/12* (2006.01)

(52) U.S. Cl.
CPC ..... *A47G 29/124* (2013.01); *A47G 29/1209* (2013.01)

(58) Field of Classification Search
CPC ..... A47G 29/1203; A47G 29/1209; A47G 29/1216; A47G 29/124; A47G 29/141; A47G 29/20; A47G 2029/1257
USPC ..... 232/17, 29, 44, 45, 1 C, 39
See application file for complete search history.

(56) References Cited

U.S. PATENT DOCUMENTS 3,144,984 A * 8/1964 Ross ..... A47G 29/1209 232/1 C
4,181,250 A * 1/1980 Withrow ..... A47G 29/1205 232/1 C
4,875,622 A * 10/1989 Lents ..... A47G 29/1216 232/39
5,361,977 A * 11/1994 Ogrodnick, Jr. ... A47G 29/1216 232/39
5,524,818 A * 6/1996 Patry ..... A47G 29/121 232/35
5,954,264 A * 9/1999 Keller ..... A47G 29/1212 232/17
6,123,257 A * 9/2000 Guidicy ..... A47G 29/1216 232/17
6,234,387 B1 * 5/2001 Cuthbert ..... A47G 29/1209 232/17
6,808,108 B1 * 10/2004 Turnbow ..... A47G 29/1209 232/17
6,957,767 B2 * 10/2005 Aupperle ..... A47G 29/1214 232/34
7,093,747 B1 * 8/2006 Marchese ..... A47G 29/1209 232/38
7,178,717 B1 * 2/2007 Lindell ..... A47G 29/1209 232/45

(Continued)

*Primary Examiner* — William L Miller

(57) ABSTRACT

A storage receptacle securing apparatus for controlling access to a storage compartment includes a housing that creates an internal compartment, where a hole extending through the housing provides access to the storage compartment of an attached storage receptacle. A sealing panel positioned inside the internal compartment is capable of sealing the hole extending through the housing such that access to the storage compartment of the storage receptacle is prevented. The apparatus is electronically powered by a remote user device in communication with an onboard electronic locking device such that the sealing panel opens to provide access to the storage compartment only when prompted to open by an authorized user device.

18 Claims, 18 Drawing Sheets

(56) References Cited

U.S. PATENT DOCUMENTS

| | | | | |
|---|---|---|---|---|
| 7,249,705 | B2 * | 7/2007 | Dudley | A47G 29/141<br>232/45 |
| 7,938,314 | B1 * | 5/2011 | Benesh | A47G 29/1209<br>232/29 |
| 8,757,476 | B2 * | 6/2014 | Childress | A47G 29/1209<br>232/17 |

* cited by examiner

METHOD AND APPARATUS FOR SECURING AND CONTROLLING ACCESS TO THE STORAGE RECEPTACLES

CROSS-REFERENCE TO RELATED APPLICATIONS

This application claims the benefit of U.S. Provisional Patent Application No. 62/270,911, filed on Dec. 22, 2015. Such application is incorporated by reference in its entirety.

STATEMENT REGARDING FEDERALLY SPONSORED RESEARCH OR DEVELOPMENT

Not applicable.

BACKGROUND OF THE INVENTION

Storage receptacles such as drop boxes, collection and deposit boxes, and safes are used in the utility, banking, and medical industries. Similar storage receptacles are used in the postal industry. These storage receptacles all serve to hold personal and valuable items. Utility and banking industries utilize these storage receptacles as a secure, after-hours convenience for customers to deposit bill payments, financial and personal documentation, and cash. Storage units and collection receptacles within the medical industries are often used to temporally store medicines for pick up and transfer. The postal service also utilizes storage receptacles for delivery and for temporarily holding incoming and outgoing mail until the mail is retrieved. Although these and other existing receptacles are designed to store articles temporarily, businesses and individuals are not always available to retrieve the content in a timely manner, which in many cases leads to theft of valuable items or information.

The ease of accessibility into curbside mailboxes, drop boxes, and collection boxes contributes to the increase in identity theft and mail fraud, both of which have been a primary concern of the Federal Trade Commission (FTC) and consumers for many years. Within the postal industry, not only are thieves tampering with mailboxes, but small businesses often gain access, not to steal, but to deposit their advertising circulars, failing to pay for postage and cheating the postal service out of hundreds of thousands of dollars in postage fees annually. Even when these receptacles are housed in brick, concrete, or other hard material, the risk of unauthorized access still exists, because the most vulnerable part of the existing storage receptacles is the service door.

The inventor hereof has recognized that preventing unauthorized entry and securing incoming and outgoing articles for these and other receptacles is the answer to eliminating these problems with theft. One alternative to controlling access is to simply lock the service door. A second alternative is to create a way to allow authorized users of these receptacles a way to freely and securely gain access. It is also desirable for these receptacles to have a means of notifying the owner/user that an authorized user has gained access. As a consequence, there is a need for a secure apparatus that controls access, safeguards incoming and outgoing articles, is tamper-proof, and resists prying into existing receptacles. Specifically, there exists a need for an attachment apparatus that controls and secures access into existing storage receptacles that are utilized by a vast majority of businesses and individuals on a daily basis.

BRIEF SUMMARY OF THE INVENTION

In general, this invention relates to a locking device apparatus, and more specifically to a locking apparatus used for providing access control of storage receptacles and for securing items in storage receptacles. The present invention is capable of being attached to an existing storage receptacle having an internal chamber for receiving and temporarily storing articles or, alternatively, may have a storage receptacle integral to the apparatus. The present invention is capable of being used whether the internal chamber of the storage receptacle is housed in brick, concrete, or other hard material. Generally, the present invention is designed to replace the service door of existing storage receptacles and is designed to secure articles and assist in limiting access to the internal compartment.

Other objectives and advantages of this invention will become apparent from the following description taken in conjunction with the accompanying drawings wherein are set forth, by way of illustration and example, certain embodiments of this invention. The drawings constitute a part of this specification, and include exemplary embodiments of the present invention and illustrate various objects and features thereof.

DETAILED DESCRIPTION OF THE PREFERRED EMBODIMENT(S)

In general, this invention relates to a locking device apparatus, and more specifically to a locking apparatus used for providing access control of a storage receptacle and securing articles in a storage receptacle. In one embodiment the locking apparatus may be retrofitted to existing storage receptacles and in other embodiments the locking apparatus may be integrated into a new storage receptacle that will replace the existing storage receptacle.

Broadly speaking, the locking apparatus comprises a panel with an opening and a door integrated into the panel such that the door is capable of exposing the opening in the panel when open and concealing the opening in the panel when closed. In one embodiment, the apparatus is attached to an existing storage receptacle such that the opening in the panel is aligned with the opening of the existing storage receptacle, such that when the door is open, the opening in the panel exposes the internal compartment of the existing storage receptacle. In an alternate embodiment, the locking apparatus is integral to a storage receptacle such that when the door is open, the internal compartment of the storage receptacle is exposed. The service door allows items to be deposited or retrieved from the internal compartment, whether integral to the apparatus or of an existing receptacle.

Figure 12:
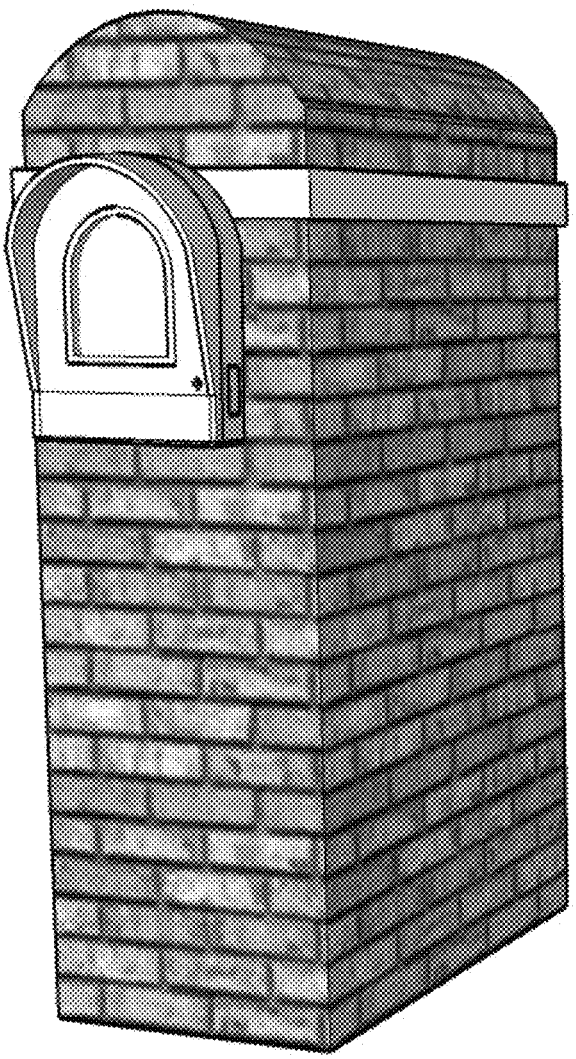
FIG. 12 illustrates a perspective view of the embodiment of the invention of FIG. 1 with the attachment apparatus installed on an existing traditional curbside mailbox housed in brick.
Figure 13:
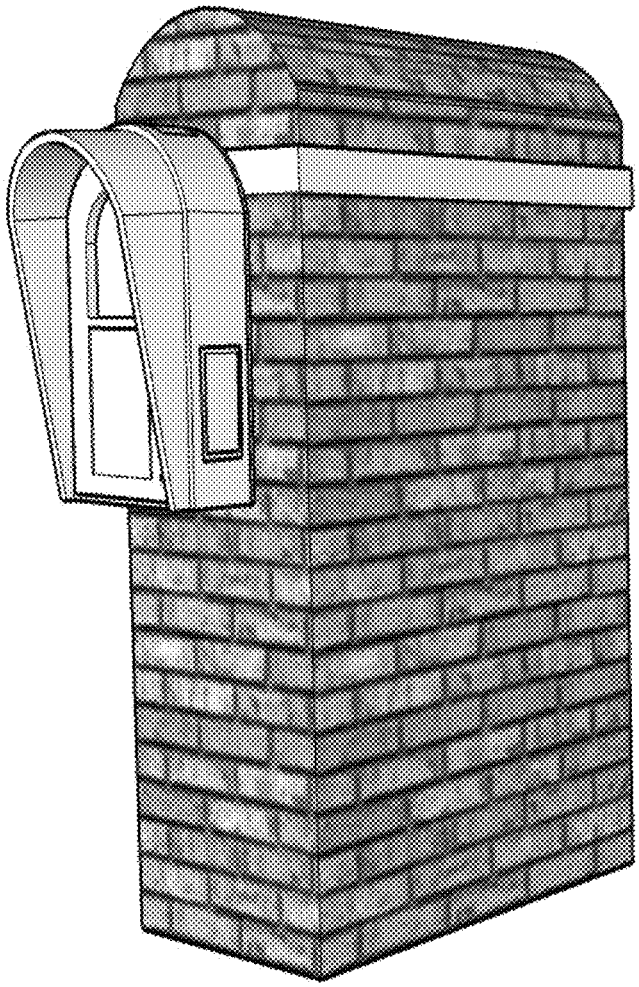
FIG. 13 illustrates a perspective view of the embodiment of the FIG. 10 with the attachment apparatus installed on an existing traditional curbside mailbox housed in brick.
Figure 14:
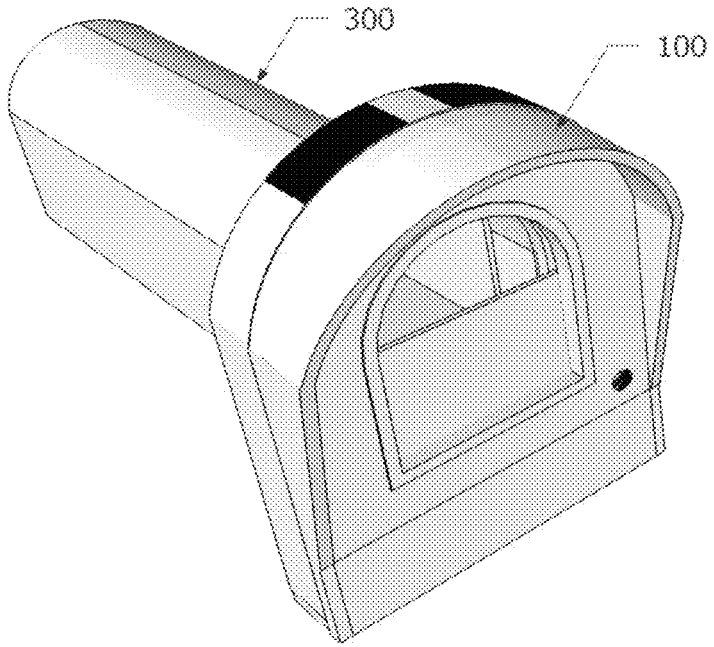
FIG. 14 illustrates a perspective view of an embodiment of the invention with an internal receptacle for holding articles preassembled to the apparatus.
Figure 15:
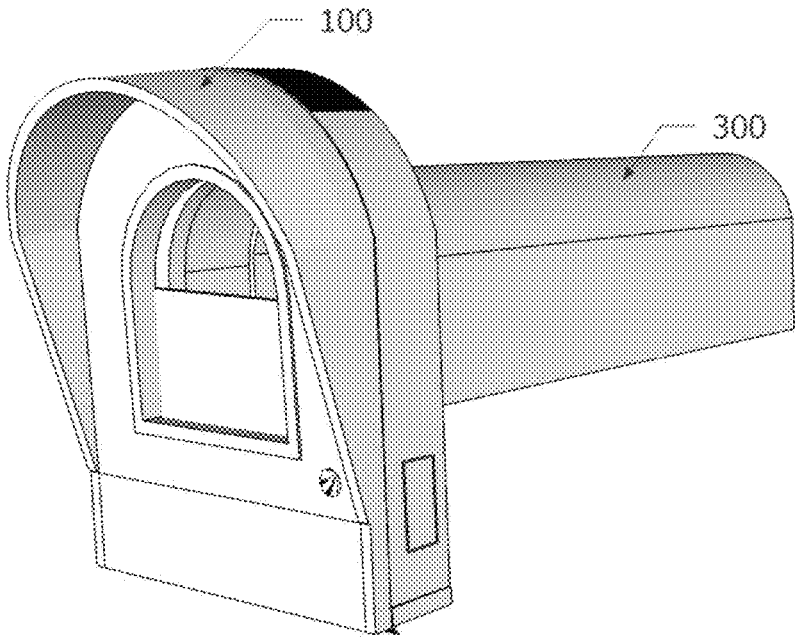
FIG. 15 illustrates a perspective view of the embodiment of the invention of FIG. 14, showing the internal receptacle preassembled at the site of the apparatus mounting bracket composing a complete unit.

Turning to the Figures, the components of the present invention can be described more fully. As noted above, certain embodiments of the present invention are capable of being retrofitted to an existing storage receptacle (FIGS. 12-13). The apparatus may replace the existing service door on the existing receptacle by means of a mounting bracket. In yet another embodiment, the apparatus may have a mounting plate that allows the apparatus to be mounted onto an existing storage receptacle. The mounting plate may be used for existing storage receptacles in which the opening does not extend from the housing. The housing plate allows the apparatus to be attached to the housing surrounding the receptacle as opposed to the receptacle itself. Alternatively, the present invention may comprise an internal compartment 300 integral to the apparatus (FIGS. 14-15).

As shown in FIGS. 1-5, in one embodiment the apparatus comprises a housing 100, a visor panel 102, and a service door 200. In certain embodiments the housing is made up of a top panel, bottom panel, front panel, back panel, and side panels, where all of the panels are joined together to create an internal compartment. The housing is preferably made of durable material such that any unauthorized user may not gain access to the valuables secured by the apparatus. For example, the housing may be made of polypropylene, metal, or any other durable material.

In some embodiments, solar cells 104 are integrated into the top panel of the device housing 100 to provide power to the apparatus such that the service door 200 can be opened using smart technology (described below). Alternatively, the apparatus may be powered by batteries which are stored in battery compartment 106 integrated into the side of the device housing 100. The device can be powered by DC electrical current, solar cell power, or a combination of both DC and solar cell power, helping to eliminate the possibility of a non-functioning device due to weak batteries or inability of solar cells to charge on cloudy days. The visor 102 is attached to the housing 100 in order to protect the service door 200 and the area immediately in front of the service door from rain, dirt, or other elements. In certain embodiments, the locking apparatus implements smart technology (described below) and a smart technology LED sensor indicator 108 is positioned on the front panel of the housing 100. A mounting bracket 202 is attached to the backside of the housing 100 such that the apparatus may be attached to a storage receptacle by a number of screws 204. The mounting bracket 202 may be configured to conform to a plurality of shapes and sizes of openings in existing storage receptacles. A component compartment 208 is also integrated into the backside of the housing 100. This compartment 208 provides access to the electronic components incorporated into the apparatus. The placement of the compartment 208 on the backside of housing 100 hides the compartment 208 from view and prevents tampering with the electronics stored in the compartment 208.

Figure 1:
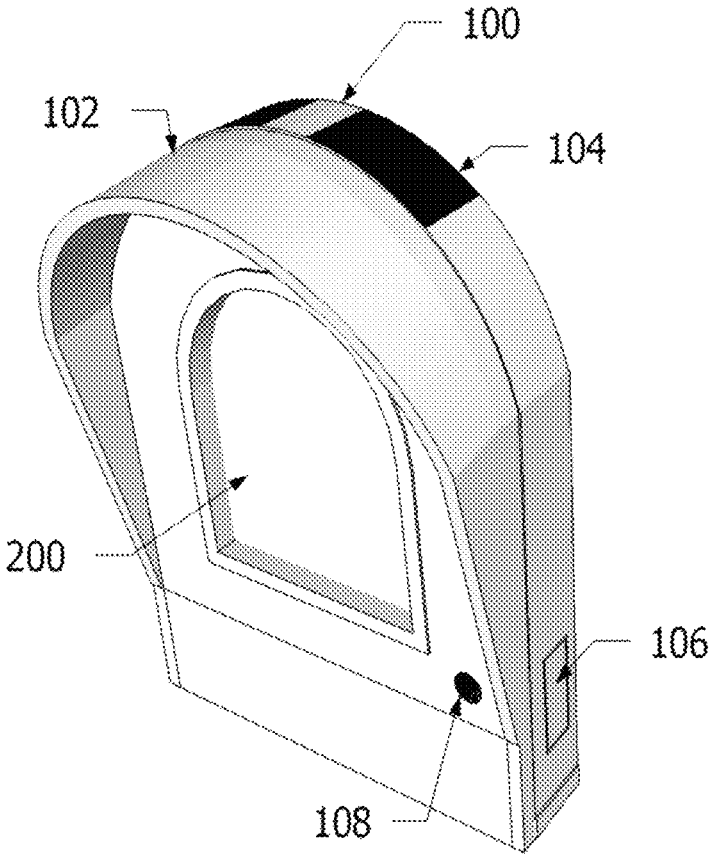
FIG. 1 illustrates an attachment apparatus according to an embodiment of the invention with the service door in the closed position.
Figure 2:
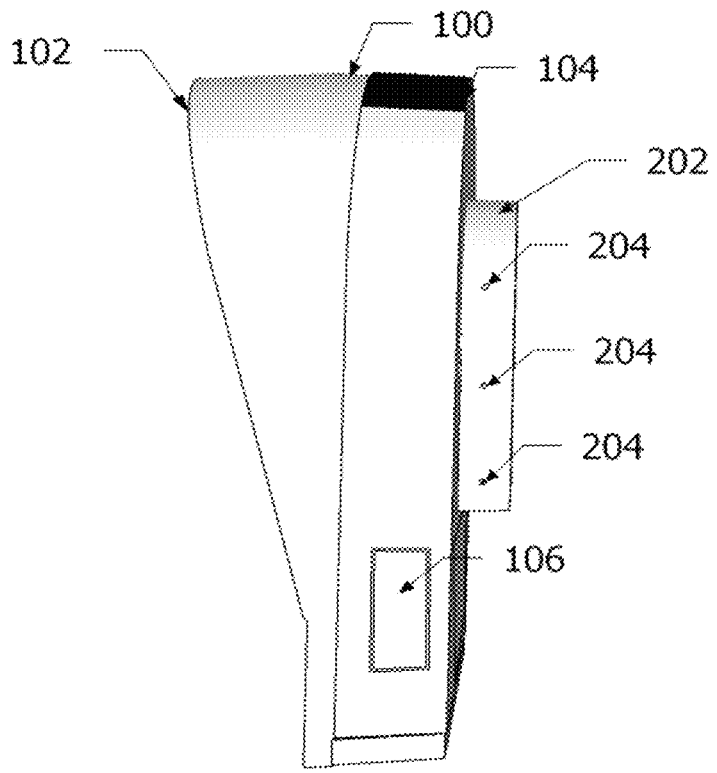
FIG. 2 illustrates a right-hand side view of an embodiment of the invention showing battery compartment and the invention mounting collar/bracket with the site where proprietary security screws are inserted.
Figure 3:
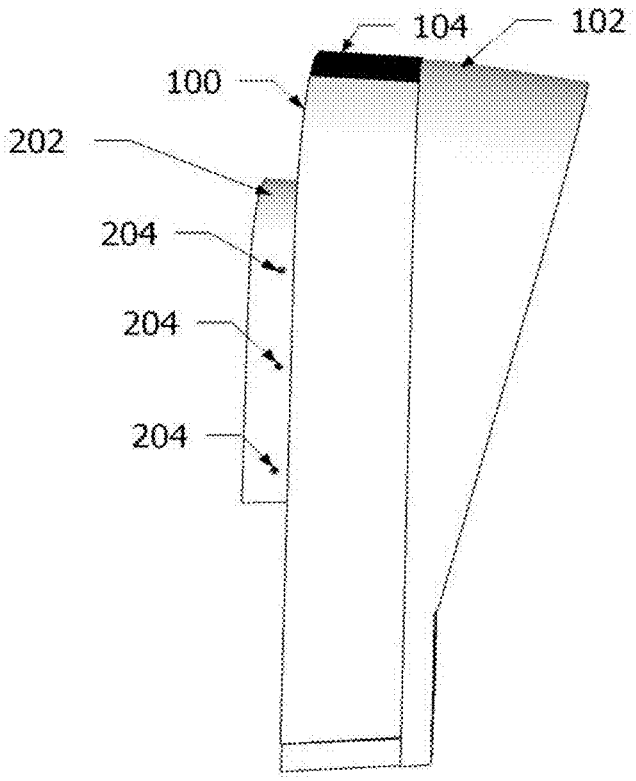
FIG. 3 illustrates a left-hand side view of an embodiment of the invention showing the invention mounting collar/bracket with proprietary security screw location.
Figure 4:
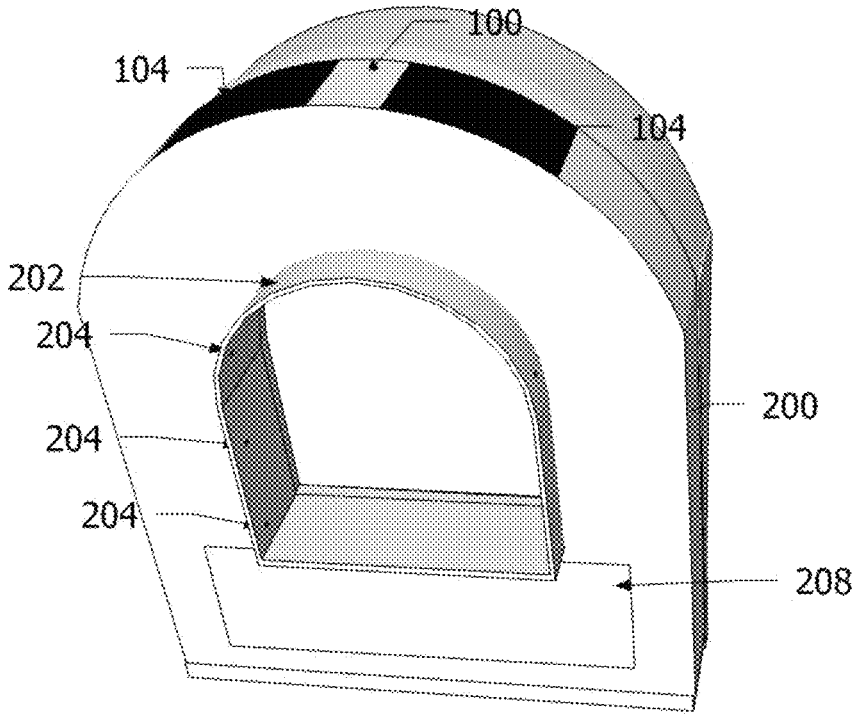
FIG. 4 illustrates a back view of an embodiment of the invention showing rear access opening and the component compartment panel; the apparatus service door is in the closed position.
Figure 5:
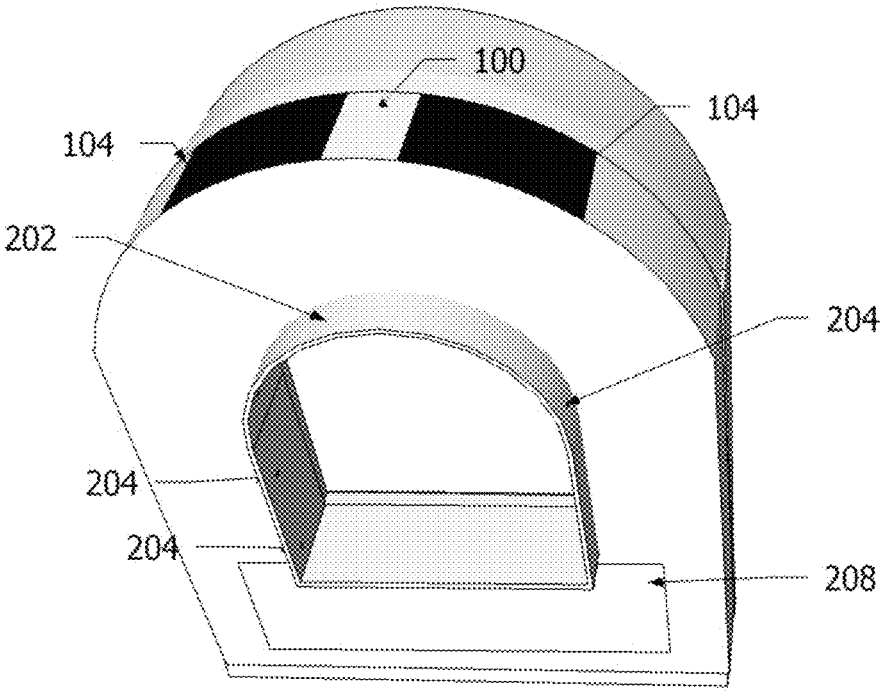
FIG. 5 illustrates a top view of the solar cells in accordance with an embodiment of the invention.
Figure 6:
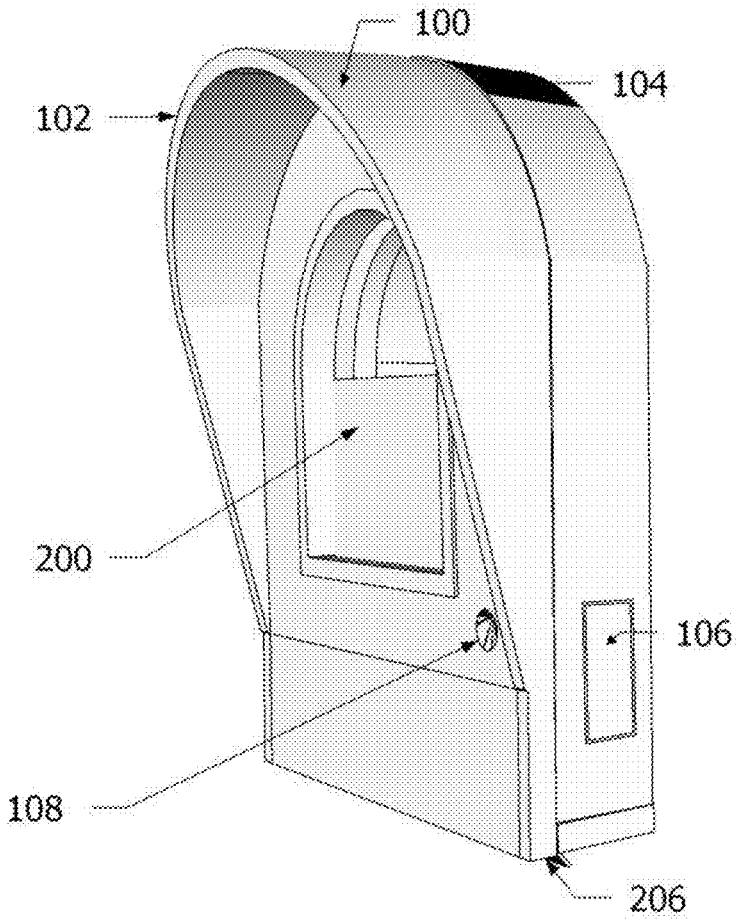
FIG. 6 illustrates a bottom view of an embodiment of the invention showing the attachment apparatus with its spring-loaded hinged hatch and service door in the closed position.
Figure 7:
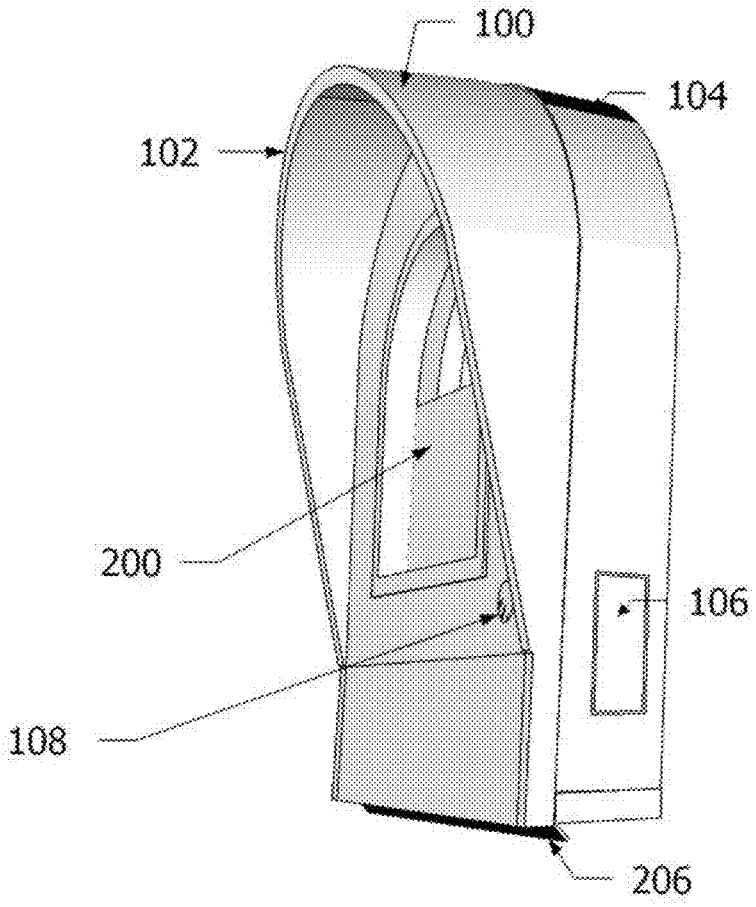
FIG. 7 illustrates a perspective view of the embodiment of the invention of FIG. 1 with the attachment apparatus showing the service door and spring-loaded hatch partially in the open position.
Figure 8:
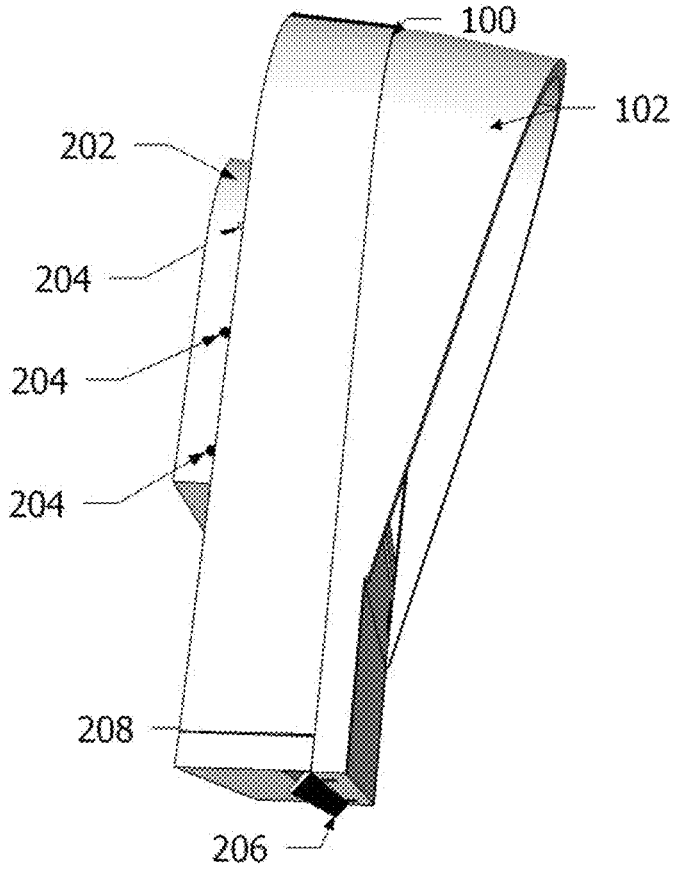
FIG. 8 illustrates a side view of the embodiment of the invention of FIG. 7 showing the partially opened service door hatch.
Figure 9:
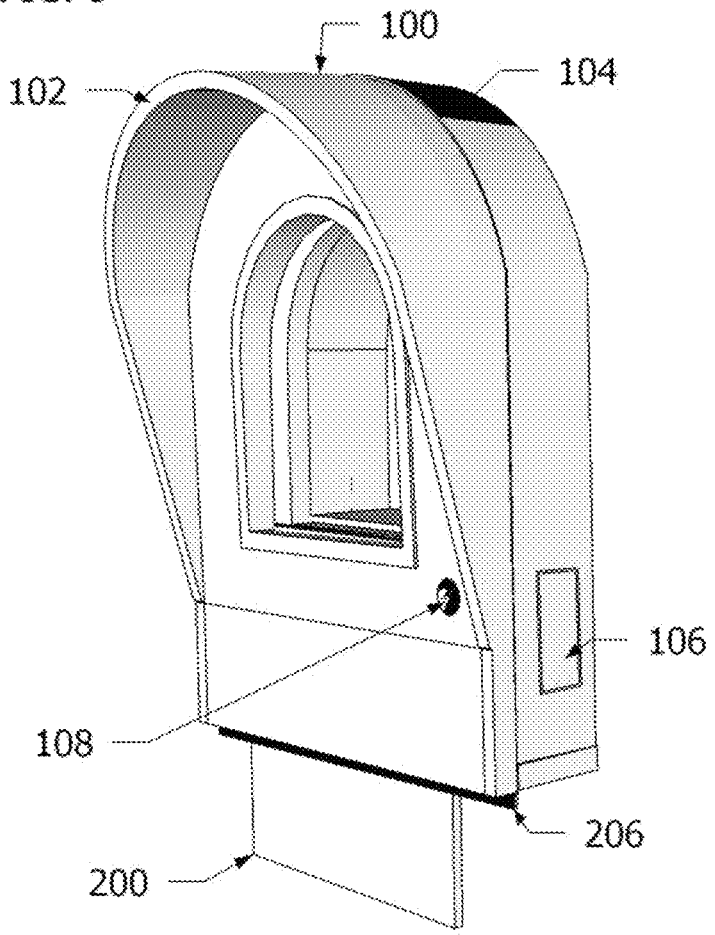
FIG. 9 illustrates a perspective view of the embodiment of the invention of FIG. 1 with the attachment apparatus depicting the service door and hatch opening in the fully open position.
Figure 10:
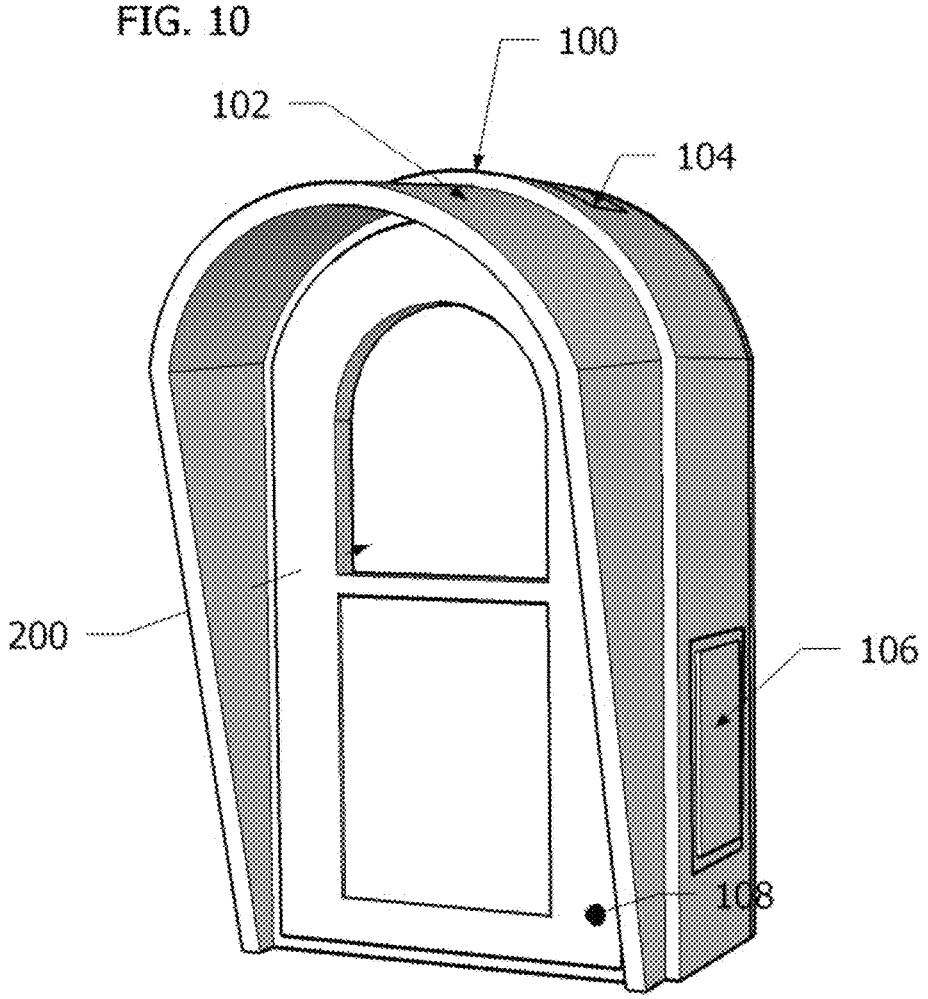
FIG. 10 illustrates a perspective view of another embodiment of the invention as an extended version of the apparatus where the service door is in the closed position.
Figure 11:
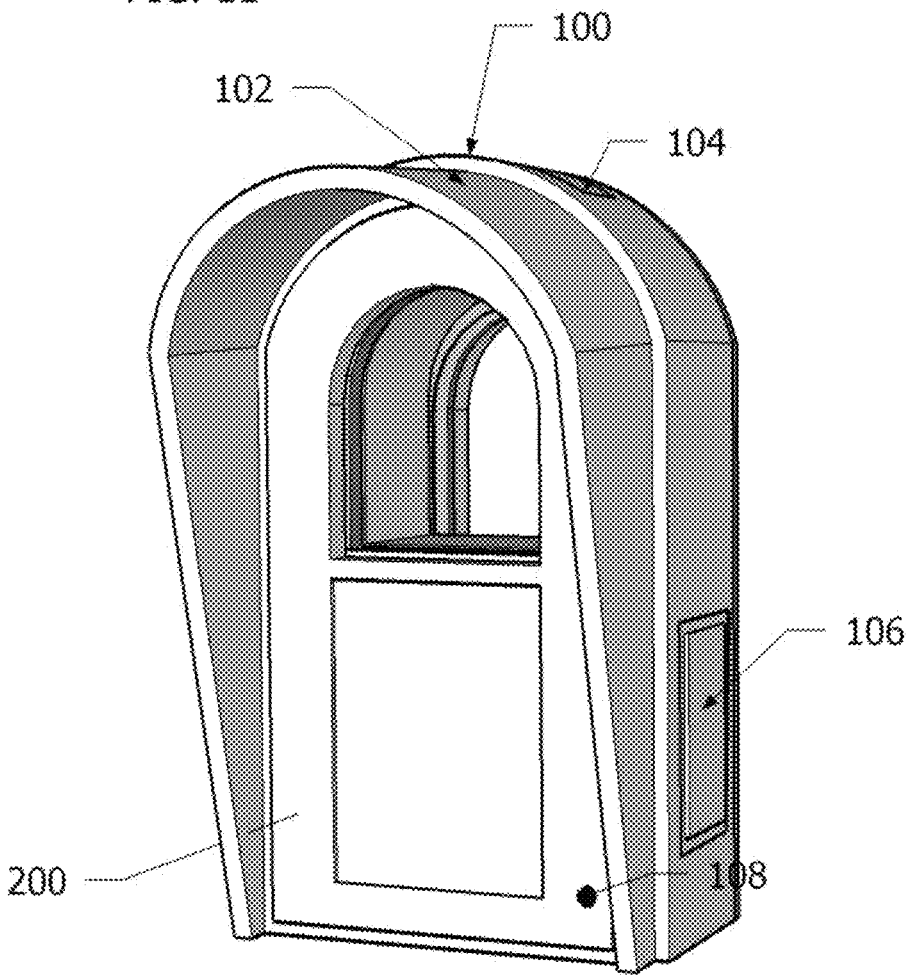
FIG. 11 illustrates a perspective view of the embodiment of the invention of FIG. 10 as an extended version where the service door is concealed in the open position.

As shown in FIGS. 6-9, in certain embodiments of the present invention may implement a spring-loaded, hinged hatch 206 integrated into the bottom side of the housing 100. In certain embodiments, service door 200 is located in an internal compartment created by the housing 100 and must extend through hatch 206 as the service door 200 is opened. In one embodiment, the hatch 206 opens downward as the service door 200 slides down to open. In an alternative embodiment, service door 200 will open by sliding upward and hatch 206 may be configured at the top of the housing 100, such that door 200 rises upward through hatch 206. FIGS. 6-8 show the hatch 206 partially opened as service door 200 is partially opened, while FIG. 9 shows the hatch 206 fully open and service door 200 fully opened, extending from the housing 100 through hatch 206. Alternatively, as shown in FIGS. 10-11, the housing 100 may be extended downwardly creating an elongated body such that when service door 200 is opened, the extended housing body 100 conceals service door 200. While in the preferred embodiment service door 200 slides upwardly or downwardly to open, in certain embodiments service door 200 may also rotate or pivot to open. FIG. 10 shows an embodiment with extended housing 100 with the service door in the closed position while FIG. 11 shows an extended housing 100 with the service door in the open position. As shown in FIG. 11 (as compared with FIG. 9), the service door is concealed in the extend portion of the housing 100.

In certain embodiments, as noted above, the apparatus implements smart technology such that the device can be operated electronically. A signal is sent to a smart technology receiver within housing 100 by means of a remote user device, which communicates with a motorized opening/closing mechanism to activate the service door 200. As noted above, these electronic components are preferably stored in a compartment 208 on the backside of the housing 100, such that no unauthorized users may gain access to the electrical components. Receivers and remote user devices that are operable with the device are well known in the art.

A signal may be sent to the receiver from any user device capable of communicating with a receiver, including but not limited to a remote control, numerical keypad, RFID tag, or any other electronic access device known in the art. In one embodiment, the use of an RFID receiver may allow an authorized RFID chip to be worn as a ring, wrist band, or key fob that allows the user to open the service door without requiring a code. In this embodiment, the user may open the service door electronically without requiring the user to locate a remote control or other bulky device. Alternatively, other well-known methods of gaining access and control may be implemented, including fingerprinting technologies. Whatever type of user device is used, the signal from the user device is capable of communicating with the signal receiver, which then communicates to the motorized mechanism to open and close the service door 200. In the event that the transmitter access code or RFID tag does not match an authorized code, the motorized mechanism will not activate the service door 200 and entry into the receptacle will be denied. In certain embodiments, an IR safety beam is implemented at an internal panel of housing 100 just behind service door 200 to prevent accidental injuries from the service door closing. The IR safety beam will communicate to the motorized mechanism not to close service door 200 in the event that an object is extending through the opening in panel 100 such that the IR safety beam is broken and the IR sensor does not detect a signal from the beam. IR safety beams of this type are known in the art, such as those commonly used as a safety measure to prevent garage doors from closing on a person, automobile, or other object in the path of the door.

Figure 16:
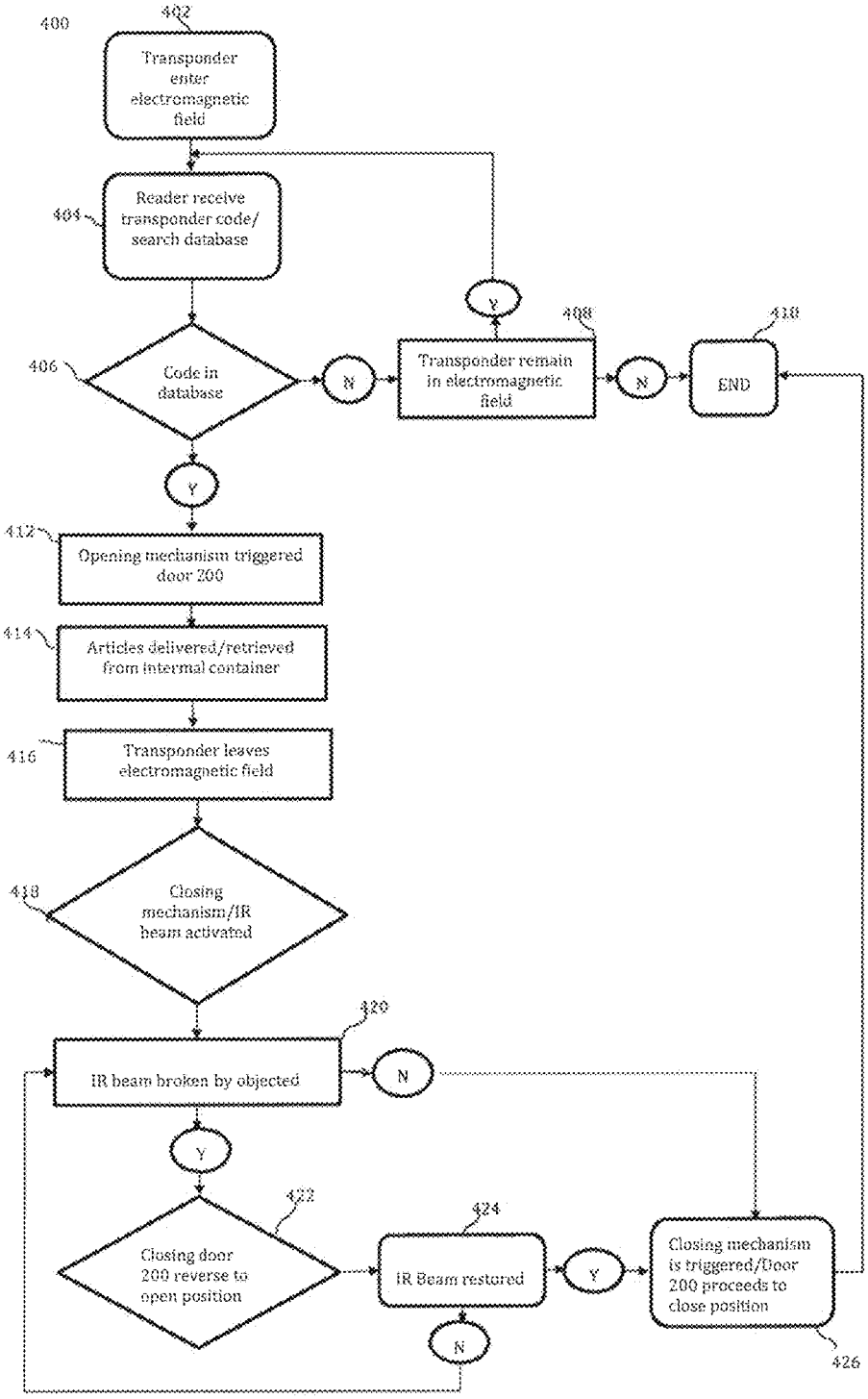
FIG. 16 is a flowchart showing a method by which an authorized user may active the attachment apparatus utilizing a transponder with an input mechanism to access the internal chamber of an embodiment of the invention.

FIG. 16 shows in flowchart form a method 400 of an authorized user activating the attachment apparatus utilizing a transponder with an input mechanism to retrieve or deliver articles within the internal chamber of the storage receptacle. The method begins in step 402 with an authorized user equipped with a transponder entering the electromagnetic field, which activates the transponder to send data to the reader, of step 404, in a transponder RF communication process. This type of response to a trigger or polling signal occurs in many embodiments and the transmitted data can include the transponder ID and/or other identifiers. In step 406, the system looks up the transponder ID in the memory or a database. In the present embodiment the database is local for a stand-alone system. In many embodiments the database may be located at a remote system. If the transponder code is not present, at step 408, the system defaults back to the beginning of the process and will continue to loop until the transponder leaves the electromagnetic field, which leads to step 410. When a valid code is discovered in the database, an opening mechanism of step 412 is initiated and triggers the service door of the attachment apparatus to open. At step 414, articles are retrieved or delivered into the internal chamber of the storage receptacle. As the authorized user steps away from the attachment apparatus and the transponder no longer emits a signal at step 416, step 418 begins the closing mechanism to trigger the service door to close and in turn activate step 420, wherein the IR safety sensors are activated. If there is no obstruction present to break the IR safety beam, the service door will continue to the closed position. However, if there is an interruption of the IR beam at step 422, the closing service door will abruptly reverse to the open position. At step 424, the operation of the IR beam can go in one of two directions; if the obstruction is not addressed, the service door will stay in the open position or if the obstruction is corrected/cleared and the beam is restored, in step 426 the closing mechanism is triggered and the service door proceed to the closing.

Figure 17:
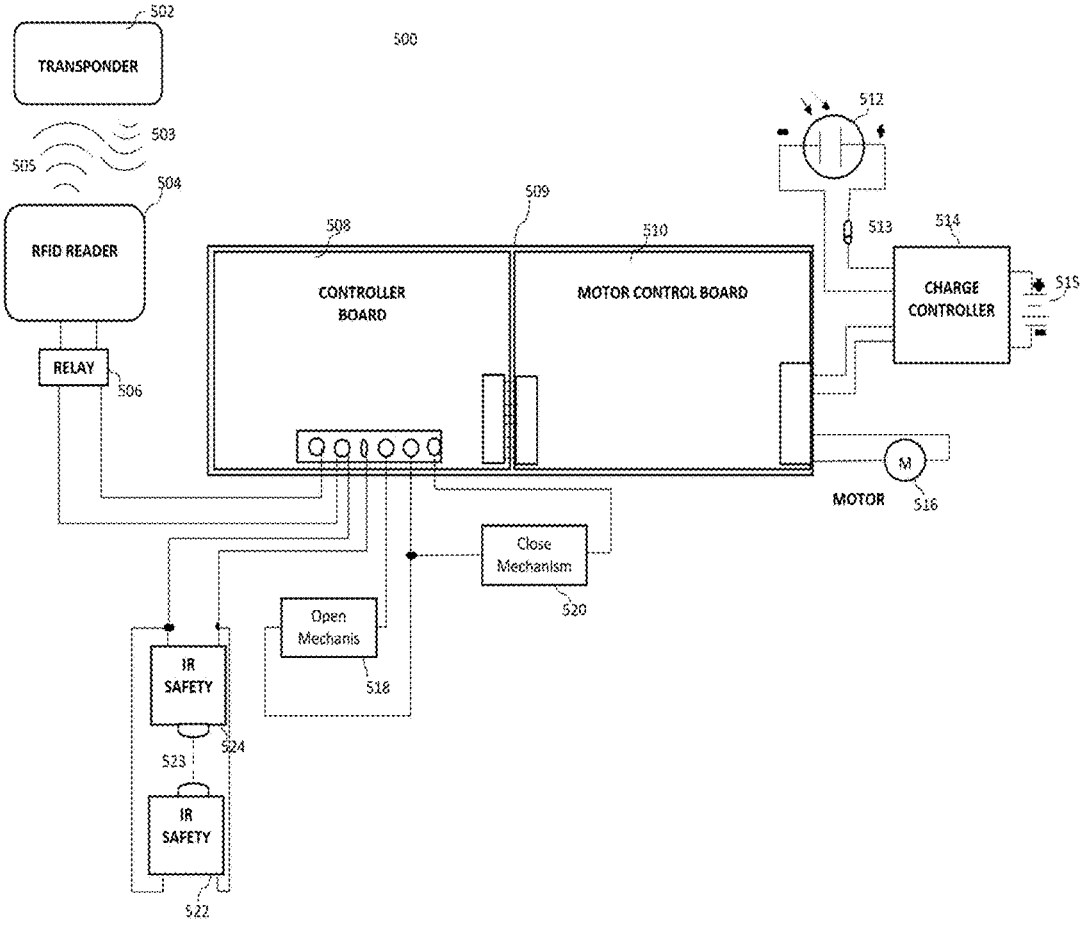
FIG. 17 is a schematic diagram illustrating the electrical components of an embodiment of the invention.
Figure 18:
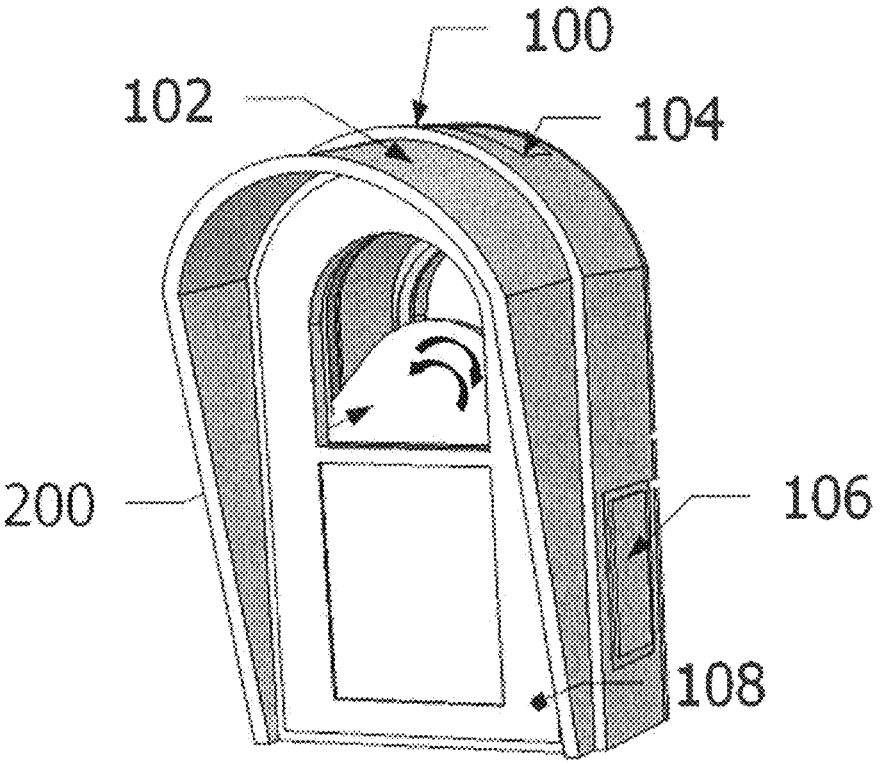
FIG. 18 illustrates an embodiment of the invention showing a service door which rotates or pivots to open.

FIG. 17 shows a schematic diagram of components which make up an RFID system according to an embodiment of the invention. The individual parts presented here in the RFID system 500 consist of off-the-shelf items found on the market. The RFID system 500 process is initiated with the presence of a RFID transponder 502. According to the present invention, the transponder 502 is passive in nature, meaning no battery is required to power the transponder 502, but instead it relies on the RFID reader 504, also known as the interrogator, for power. The reader 504 radiates energy, via an embedded antenna, from the device into electromagnetic field 505 such that when the transponder 502 is presented within the field 505, this energizes or wakes up the transponder 502, and an exchange 503 of data takes place and is received by the RFID reader 504 antenna. The data is passed along to the inner working components of the RFID reader 504 for processing and decoding. When the data has been verified, a command or signal according to the present invention is transmitted to the relay 506. The relay 506 is wired to a typical garage door opener circuit board 509, where the wall-mounted button would normally be placed. The signal of the relay 506 would be processed by the microprocessor 508 as a command similar to that of an actual wall-mounted button being pressed. The command is further processed to the motor control board 510, where the command triggers the open mechanism 518 or close mechanism 520 that drives the service door of the attachment apparatus. The IR safety sensors, 522 and 524, according to the present invention, are activated when the closing mechanism is triggered to close the service door. A beam 523 is created and spans the front opening of the attachment apparatus. In the event that an object breaks the beam 523, the closing service door is abruptly reversed to the open position. Once the beam 523 connection is restored, the closing mechanism is triggered and the service door resumes to the closing position. The RFID system 500 is powered by direct current 515, more specifically, rechargeable batteries and solar power delivered by solar cell panel 512. Also included in this power circuit according to the present invention is a diode 513 connected to the positive lead of the solar panel, which prevents the battery from leaking back current into the solar cells and thus depleting the battery power. Power produced by the solar panel 512 is used by the charge controller 514 for charging the batteries. The charge controller 512 protects the batteries 515 from a variety of conditions such as overcharging and excess current, also converting the unregulated solar energy into favorable energy for the batteries 515.

An example of use of the present invention may be described with reference to FIGS. 12-13, in which the apparatus is mounted to an existing receptacle (in this example, a brick-enclosed mailbox). Although it is understood that the apparatus may be used in any number of receptacles, the mailbox provides an example of existing receptacles to which the apparatus may be attached. To attach the apparatus to the mailbox, the mailbox's existing service door is removed from the storage receptacle and the apparatus is positioned in place of the service door using the mounting bracket. Thus, the apparatus allows for the conversion of a simple mailbox into an electronic safe that controls access to the articles contained within.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. When a grouping is used herein, all individual members of the group and all combinations and subcombinations possible of the group are intended to be individually included. When a range is stated herein, the range is intended to include all subranges and individual points within the range. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention, as set forth in the appended claims.

The invention claimed is:

1. A storage receptacle securing apparatus comprising:

a. a device housing comprising a front panel, a back panel, a top panel, a bottom panel, and two side panels, wherein said top panel, bottom panel and two side panels are joined between said front panel and back panel forming an internal compartment;

b. an opening in the front panel and an opening in the back panel, wherein the opening in the front panel and the opening in the back panel form a hole in the device housing extending through the internal compartment;

c. a sealing panel positioned inside the internal compartment, wherein the sealing panel has an open position and a closed position, wherein the sealing panel seals the hole in the device housing when the sealing panel is in the closed position, further wherein the sealing panel reveals the hole in the device housing when the sealing panel is in the open position;

d. a storage receptacle attached to the back panel, wherein the storage receptacle comprises a mouth, further wherein the storage receptacle comprises a storage compartment, wherein the mouth of the storage receptacle is aligned with the hole in the device housing, whereby the storage compartment is accessible when the sealing panel is in the open position and whereby the storage compartment is inaccessible when the sealing panel is in the closed position; and e. an electronically powered locking mechanism in communication with the sealing panel and comprising a motor, wherein the electronically powered locking mechanism opens and closes the sealing panel.

2. The apparatus of claim 1, further comprising an electronics storage compartment positioned in the back panel, wherein the electronically powered locking mechanism is stored in the electronics storage compartment.

3. The apparatus of claim 1, wherein the electronically powered locking mechanism is in communication with an authorized user remote device, further wherein the authorized user remote device signals to the motor to at least one of open and close the sealing panel.

4. The apparatus of claim 3, further comprising a sensor indicator situated on the front panel of the device housing.

5. The apparatus of claim 3, wherein the electronically powered locking device comprises an RFID reader, further wherein the user remote device is an RFID chip.

6. The apparatus of claim 1, wherein the sealing panel is slidably attached to the front panel.

7. The apparatus of claim 6, wherein the sealing panel slides downward when the sealing panel is in the open position and wherein the sealing panel slides upward when the sealing panel is in the closed position.

8. The apparatus of claim 6, wherein the sealing panel slides upward when the sealing panel is in the open position and wherein the sealing panel slides downward when the sealing panel is in the closed position.

9. The apparatus of claim 1, wherein the sealing panel is rotatably attached to the front panel.

10. The apparatus of claim 9, wherein the sealing panel rotates to reveal the hole extending through the internal compartment when the sealing panel is in the open position.

11. The apparatus of claim 1, further comprising a visor panel attached to the front panel of the device housing, wherein the visor panel extends substantially perpendicular from the front panel of the device housing, thereby covering an area immediately in front of the front panel of the device housing.

12. The apparatus of claim 1, further comprising a power supply configured to power the electronically powered locking device.

13. The apparatus of claim 12, wherein the power supply is a plurality of batteries.

14. The apparatus of claim 12, wherein the power supply comprises a plurality of solar panels.

15. The apparatus of claim 1, wherein the device housing extends downward whereby the sealing panel is entirely concealed by the device housing when the sealing panel is in the open position.

16. The apparatus of claim 1, further comprising a safety obstruction device inside the internal compartment of the device housing operable to prevent the sealing panel from moving to the closed position when an obstruction is present.

17. The apparatus of claim 16, wherein the safety obstruction device comprises an infrared beam emitter and a sensor, whereby an object inserted in the hole of the device housing will disrupt a beam emitted between the infrared beam and sensor.

18. The apparatus of claim 1, wherein the back panel is attached to the storage receptacle by a mounting bracket.

* * * * *